US011250783B2

(12) United States Patent
Hu et al.

(10) Patent No.: US 11,250,783 B2
(45) Date of Patent: Feb. 15, 2022

(54) GATE DRIVER ON ARRAY CIRCUIT, PIXEL CIRCUIT OF AN AMOLED DISPLAY PANEL, AMOLED DISPLAY PANEL, AND METHOD OF DRIVING PIXEL CIRCUIT OF AMOLED DISPLAY PANEL

(71) Applicants: BOE Technology Group Co., Ltd., Beijing (CN); Hefei Xinsheng Optoelectronics Technology Co., Ltd., Anhui (CN)

(72) Inventors: Zuquan Hu, Beijing (CN); Xiping Wang, Beijing (CN)

(73) Assignees: BOE Technology Group Co., Ltd., Beijing (CN); Hefei Xinsheng Optoelectronics Technology Co., Ltd., Anhui (CN)

( * ) Notice: Subject to any disclaimer, the term of this patent is extended or adjusted under 35 U.S.C. 154(b) by 815 days.

(21) Appl. No.: 16/080,944

(22) PCT Filed: Aug. 16, 2017

(86) PCT No.: PCT/CN2017/097643
§ 371 (c)(1),
(2) Date: Aug. 29, 2018

(87) PCT Pub. No.: WO2019/033294
PCT Pub. Date: Feb. 21, 2019

(65) Prior Publication Data

US 2021/0183317 A1 Jun. 17, 2021

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0408* (2013.01);
(Continued)

(58) Field of Classification Search
CPC ..... G09G 3/3266; G09G 3/3674–3681; G09G 2310/0286; G09G 3/3233–3/3258
See application file for complete search history.

(56) References Cited

U.S. PATENT DOCUMENTS 7,932,887 B2 * 4/2011 Kim ..... G11C 19/28 345/100
8,232,984 B2 7/2012 Kwon et al.
(Continued)

FOREIGN PATENT DOCUMENTS

CN 101599257 A 12/2009
CN 103198867 A 7/2013
(Continued)

OTHER PUBLICATIONS

International Search Report & Written Opinion dated May 15, 2018, regarding PCT/CN2017/097643.
(Continued)

*Primary Examiner* — Patrick F Marinelli
(74) *Attorney, Agent, or Firm* — Intellectual Valley Law, P.C.

(57) ABSTRACT

A gate-driver-on-array (GOA) circuit includes N GOA units cascaded in series to generate N sets of driving signals. Each n-th GOA unit includes a first terminal configured to receive a high-level voltage, a second terminal configured to receive a low-level voltage, and a clock signal terminal configured to receive a clock signal, an input terminal and a reset terminal respectively configured to receive internal signals from two alternative GOA units in the series, a first output terminal configured to output a gate-driving signal, and a second output terminal configured to output a node voltage signal. Each n-th set of the N sets of driving signals includes a first driving signal being a gate-driving signal from a (n−1)th GOA unit, a second driving signal being a gate-driving signal from a n-th GOA unit, and a third driving
(Continued)

signal being a node voltage signal from the n-th GOA unit for driving an AMOLED pixel circuit.

17 Claims, 8 Drawing Sheets

(52) U.S. Cl.
CPC ..... *G09G 2300/0819* (2013.01); *G09G 2300/0842* (2013.01); *G09G 2300/0861* (2013.01); *G09G 2310/0262* (2013.01); *G09G 2310/0286* (2013.01); *G09G 2310/08* (2013.01); *G09G 2320/0233* (2013.01); *G09G 2320/043* (2013.01); *G09G 2320/045* (2013.01)

(56) References Cited

U.S. PATENT DOCUMENTS 8,243,058 B2 * 8/2012 Lee ..... G11C 19/184 345/213
8,411,016 B2 * 4/2013 Tanikame ..... G09G 5/001 345/100
8,494,108 B2 * 7/2013 Hsu ..... G11C 19/28 377/64
8,587,347 B2 * 11/2013 Yoon ..... H03K 3/012 327/108
8,816,728 B2 * 8/2014 Yoon ..... H03K 3/012 327/108
9,123,283 B2 * 9/2015 Wang ..... G11C 19/28
9,412,306 B2 * 8/2016 Kim ..... G09G 3/3266
9,502,135 B2 * 11/2016 Zeng ..... G11C 19/28
9,589,519 B2 * 3/2017 Hwang ..... G09G 3/3648
9,830,845 B2 * 11/2017 Lim ..... G09G 3/20
9,966,957 B2 * 5/2018 Zheng ..... G11C 19/28
10,140,910 B2 * 11/2018 Wang ..... G11C 19/184
10,210,836 B2 * 2/2019 Park ..... G09G 3/3677
10,223,992 B2 * 3/2019 Du ..... G09G 3/3677
10,467,946 B2 * 11/2019 Hwang ..... G11C 19/28
10,565,935 B2 * 2/2020 Zeng ..... G09G 3/3266
10,593,284 B2 * 3/2020 Yang ..... G09G 3/20
10,636,377 B2 * 4/2020 Cheng ..... G09G 3/20
10,748,476 B2 * 8/2020 Zhao ..... G09G 3/3266
10,811,114 B2 * 10/2020 Yuan ..... G09G 3/3677
10,861,394 B2 * 12/2020 Jang ..... G09G 3/32
10,957,242 B2 * 3/2021 Hwang ..... G11C 19/28
2003/0103022 A1 * 6/2003 Noguchi ..... G09G 3/3266 345/77
2005/0264496 A1 * 12/2005 Shin ..... G09G 3/3233 345/76
2007/0124633 A1 * 5/2007 Kim ..... G09G 3/3233 714/726
2008/0001904 A1 * 1/2008 Kim ..... G09G 3/3677 345/100
2008/0191968 A1 8/2008 Kawabe
2008/0246698 A1 * 10/2008 Eom ..... G09G 3/3266 345/76
2009/0303169 A1 * 12/2009 Tanikame ..... G09G 3/325 345/100
2010/0207928 A1 * 8/2010 Lee ..... G11C 19/28 345/213
2011/0142191 A1 6/2011 Tobita et al.
2012/0170707 A1 * 7/2012 Hsu ..... G11C 19/28 377/79
2013/0027287 A1 1/2013 Byeong-Jae et al.
2014/0118237 A1 * 5/2014 Wang ..... G11C 19/28 345/100
2014/0267214 A1 * 9/2014 Hwang ..... G09G 3/2092 345/212
2015/0077319 A1 3/2015 Yao et al.
2015/0302935 A1 * 10/2015 Zeng ..... G11C 19/28 377/64
2015/0340102 A1 11/2015 Qian
2016/0019833 A1 * 1/2016 Wei ..... G09G 3/3266 345/690
2016/0180964 A1 6/2016 Hu et al.
2016/0210890 A1 * 7/2016 Lim ..... G09G 3/20
2016/0253975 A1 9/2016 Yang et al.
2016/0275834 A1 9/2016 Wang et al.
2016/0351124 A1 * 12/2016 Kim ..... G09G 3/3241
2016/0351159 A1 * 12/2016 Yang ..... G11C 19/28
2016/0372023 A1 * 12/2016 Zhang ..... G09G 3/2092
2017/0010731 A1 * 1/2017 Zhang ..... G06F 3/04184
2017/0046998 A1 2/2017 Zhang et al.
2017/0069263 A1 3/2017 Hu
2017/0084222 A1 3/2017 Sun et al.
2017/0092193 A1 * 3/2017 Na ..... G09G 3/3233
2017/0140698 A1 * 5/2017 Hwang ..... G09G 3/3648
2017/0162112 A1 * 6/2017 Ha ..... G09G 3/3233
2017/0169783 A1 * 6/2017 Xiao ..... G09G 3/3677
2017/0193887 A1 * 7/2017 Wang ..... G11C 19/184
2018/0091151 A1 * 3/2018 Zheng ..... G11C 19/28
2018/0122322 A1 * 5/2018 Ji ..... H03K 17/6871
2018/0122323 A1 * 5/2018 Park ..... H01L 27/1248
2018/0218699 A1 * 8/2018 Du ..... G09G 3/3677
2018/0240395 A1 * 8/2018 Liao ..... G09G 3/20
2018/0301200 A1 * 10/2018 Shang ..... G09G 3/20
2018/0335814 A1 * 11/2018 Shao ..... G06F 1/24
2018/0336957 A1 11/2018 Mi et al.
2019/0073960 A1 * 3/2019 Zeng ..... G09G 3/3266
2019/0156779 A1 * 5/2019 Cheng ..... G09G 3/3688
2019/0164498 A1 * 5/2019 Jang ..... G09G 3/3266
2019/0279588 A1 * 9/2019 Kim ..... G09G 3/36
2019/0347987 A1 * 11/2019 Zhao ..... G09G 3/3225
2020/0020269 A1 * 1/2020 Hwang ..... G09G 3/3677
2020/0027516 A1 * 1/2020 Feng ..... G11C 19/287

FOREIGN PATENT DOCUMENTS

CN 103226979 A 7/2013
CN 103345941 A 10/2013
CN 103985346 A 8/2014
CN 104392699 A 3/2015
CN 104409047 A 3/2015
CN 104425035 A 3/2015
CN 104616616 A 5/2015
CN 104616617 A 5/2015
CN 105139795 A 12/2015
CN 105528986 A * 4/2016 ..... G11C 19/28
CN 105869562 A 8/2016
CN 106548740 A 3/2017
CN 106782267 A 5/2017
CN 107039011 A 8/2017
JP 2006195459 A 7/2006
JP 2011123963 A 6/2011
JP 2016516254 A 6/2016
WO 2016095545 A1 6/2016

OTHER PUBLICATIONS

First Office Action in the Chinese Patent Application No. 201780000832.5, dated Dec. 3, 2020; English translation attached.
Second Office Action in the Chinese Patent Application No. 201780000832.5, dated May 27, 2021; English translation attached.
First Office Action in the Japanese Patent Application No. 2018564907, dated Jun. 15, 2021; English translation attached.
First Office Action in the Indian Patent Application No. 201827036152, dated Feb. 22, 2021.
Extended European Search Report in the European Patent Application No. 17901320.6, dated Feb. 8, 2021.
Second Office Action in the Japanese Patent Application No. 2018564907, dated Nov. 30, 2021; English translation attatched.

* cited by examiner

GATE DRIVER ON ARRAY CIRCUIT, PIXEL CIRCUIT OF AN AMOLED DISPLAY PANEL, AMOLED DISPLAY PANEL, AND METHOD OF DRIVING PIXEL CIRCUIT OF AMOLED DISPLAY PANEL

CROSS-REFERENCE TO RELATED APPLICATION

This application is a national stage application under 35 U.S.C. § 371 of International Application No. PCT/CN2017/097643, filed Aug. 16, 2017, the contents of which are incorporated by reference in the entirety.

TECHNICAL FIELD

The present invention relates to field of display technology, more particularly, to a gate driver on array circuit, a pixel circuit of an active matrix organic light emitting diode display panel, an active matrix organic light emitting diode display panel, and a method of driving a pixel circuit of an active matrix organic light emitting diode display panel.

BACKGROUND

The active matrix organic light emitting diode (AMOLED) display apparatuses have many advantages over thin-film transistor liquid crystal display (TFT-LCD) apparatuses due to attributes such as wide viewing angles, highly saturated colors, fast response, high contrast ratio, and an ultrathin panel. Organic light emitting diode (OLED) display apparatuses are current driven apparatuses. An active matrix of thin film transistors (TFTs), usually formed in a Gate Driver on Array (GOA) circuit, is designed to provide a programmable current source at each pixel. A GOA circuit includes N GOA units cascaded in series for generating N gate-driving signals outputted to N gate lines for controlling N rows of TFTs that control the current flowing through the corresponding light emitting diode of each pixel in each row.

SUMMARY

In one aspect, the present invention provides a gate driver on array (GOA) circuit comprising a plurality of GOA units cascaded in a multi-stage series of one GOA unit per stage and configured to generate at least two driving signals per stage with a timing arrangement for driving one row of pixel circuits of an AMOLED display panel, wherein the at least two driving signals in any stage include at least one output signals from a GOA unit of a present stage and at least one output signal from a GOA unit of a previous stage of the any stage.

Optionally, the plurality of GOA units comprise N GOA units from a 1st GOA unit to a N-th GOA unit, each n-th stage GOA unit selected from the N GOA units, where N is integer greater than 2 and n varies from 1 to N, including a first power-supply terminal configured to receive a high-level power-supply voltage, a second power-supply terminal configured to receive a low-level power-supply voltage, a clock signal terminal configured to receive a clock signal, an input terminal configured to receive an output signal from a GOA unit in one of previous stages as an input signal for the input terminal, a reset terminal configured to receive an output signal from a GOA unit in one of next stages as a reset signal for the reset terminal, a first output terminal configured to output a gate-driving signal, and a second output terminal configured to output a node voltage signal.

Optionally, the input terminal of the n-th stage GOA unit is configured to receive an output signal from a (n−2)-th stage GOA unit as the input signal; and the reset terminal of the n-th stage GOA unit is configured to receive an output signal from a (n+2)-th stage GOA unit as the reset signal.

Optionally, the at least two driving signals in the n-th stage, where $2<n\leq N$, include a first driving signal, a second driving signal, and a third driving signal; the first driving signal is a gate-driving signal from the first output terminal of the (n−1)th stage GOA unit; the second driving signal is the gate-driving signal from the first output terminal of the n-th stage GOA unit; and the third driving signal is the node voltage signal from the second output terminal of the n-th stage GOA unit.

Optionally, input terminals of the 1st stage GOA unit and the 2nd stage GOA unit of the N GOA units are configured to receive a start signal provided by a controller as input signals respectively for the 1st stage GOA unit and the second stage GOA unit; and the at least two driving signals of the 1st-stage includes a first driving signal, a second driving signal, and a third driving signal; the first driving signal is the start signal; the second driving signal is a gate-driving signal from the first output terminal of the 1st-stage GOA unit; and the third driving signal is the node voltage signal from the second output terminal of the 1st-stage GOA unit.

Optionally, the N GOA units cascaded in series comprises M groups of GOA units cascaded in series, each of the M groups of GOA units including J GOA units cascaded in series.

Optionally, the GOA circuit further comprises a first external voltage line providing the start signal, a second external voltage line connected commonly to the first power-supply terminal of each of the N GOA units to supply the high-level power-supply voltage, a third external voltage line connected commonly to the second power-supply terminal of each of the N GOA units to supply the low-level power-supply voltage, and J clock signal lines respectively connected to the clock signal terminals of J GOA units in each of the M groups to respectively provide J clock signals.

Optionally, each of the J GOA units of each group comprises a first transistor having a gate and a first terminal commonly coupled to the input terminal and a second terminal coupled to a pull-up node; a second transistor having a gate coupled to the reset terminal, a first terminal coupled to the pull-up node, and a second terminal coupled to the third external voltage line; a third transistor having a gate coupled to the pull-up node, a first terminal coupled to one of K clock signal lines; a fourth transistor having a gate coupled to the reset terminal, a first terminal coupled to the first output terminal, and a second terminal coupled to the third external voltage line; a fifth transistor having a gate coupled to a pull-down node, a first terminal coupled to the pull-up node, and a second terminal coupled to the third external voltage line; a sixth transistor having a gate coupled to the pull-down node, a first terminal coupled to the first output terminal, and a second terminal coupled to the third external voltage line; a seventh transistor having a gate and a first terminal commonly connected to the second external voltage line, and a second terminal coupled to a pull-down control node; an eighth transistor having a gate coupled to the pull-down control node, a first terminal coupled to the second external voltage line, and a second terminal coupled to the pull-down node; a ninth transistor having a gate coupled to the pull-up node, a first terminal coupled to the pull-down control node, and a second terminal coupled to the third external voltage line; a tenth transistor having a gate coupled to the pull-up node, a first terminal coupled to the pull-down node, and a second terminal coupled to the third external voltage line; and a capacitor having a first terminal coupled to the pull-up node and a second terminal coupled to the first output terminal.

Optionally, the pull-down node is coupled to the second output terminal so that the node voltage signal outputted at the second output terminal is equivalent to a voltage level at the pull-down node.

Optionally, the J clock signals are provided sequentially from a 1st clock signal to a J-th clock signal with a time-delay for any subsequently next clock signal, the 1st clock signal being provided with the time-delay relative to the start signal.

Optionally, the time-delay is 1/J of one clock period; and each clock signal is provided with one high-level pulse voltage during the one clock period.

Optionally, the first driving signal of the n-th stage is a high-level pulse voltage with a first rising edge in a first time point of a first time period of a pixel-driving cycle, the first driving signal of the n-th stage being in-phase with a clock signal supplied to the (n−1)-th stage GOA unit; the second driving signal of the n-th stage is a high-level pulse voltage with a second rising edge in a second time point of the first time period, the second driving signal of the n-th stage being in-phase with a clock signal supplied to the n-th stage GOA unit, the second time point being later in time relative to the first time point; and the third driving signal of the n-th stage is a low-level signal during the first time period, the third driving signal being the same as the pull-down node voltage of the n-th stage GOA unit.

Optionally, the first driving signal becomes a low-level signal at a third time point at which the first time period ends and a second time period of the pixel-driving cycle starts, the third time point being later in time relative to the second time point; the second driving signal remains to be the high-level pulse voltage in the second time period; and the third driving signal remains to be the low-level signal during the second time period.

Optionally, the first driving signal remains to be the low-level signal in a third time period of the pixel-driving cycle, the third time point being later in time relative to the second time point; the second driving signal becomes a low-level signal at a fourth time point at which the second time period ends and the third time period starts; and the third driving signal becomes a high-level signal at the fourth time point and remains to be the high-level signal in the third time period.

In another aspect, the present invention provides a pixel circuit of an AMOLED display panel driven by a first driving signal, a second driving signal, and a third driving signal from one stage of the GOA circuit described herein and supplied with a current-source high-level voltage, a low-level voltage, a first external voltage, a second external voltage, and a data signal.

Optionally, the pixel circuit comprises a first transistor having a drain being supplied with the current-source high-level voltage, a gate coupled to a first node, and a source coupled to a third node; a second transistor having a drain being supplied with the first external voltage, a gate receiving the second driving signal, a source coupled to the first node; a third transistor having a drain being supplied with the data signal, a gate received the second driving signal, and a source coupled to a second node; a fourth transistor having a drain coupled to the first node, a gate receiving the third driving signal, and a source coupled to the second node; a fifth transistor having a drain being supplied with the second external voltage, a gate receiving the first driving signal, and a source coupled to the third node; a first capacitor having a first terminal coupled to the second node and a second terminal coupled to the third node; a second capacitor having a first terminal coupled to the third node and a second terminal being supplied with the low-level voltage; and a light emitting diode having an anode coupled to the third node and a cathode being supplied with the low-level voltage.

Optionally, in a first time period of a driving cycle, the first driving signal is provided as a high-level pulse voltage starting from a first time point, the second driving signal is provided as a low-level signal first and as a high-level pulse voltage from a second time point in the first time period being later in time relative to the first time point, the third driving signal is provided as a low-level signal; in a second time period subsequent to the first time period, the first driving signal becomes a low-level signal, the second driving signal remains to be the high-level pulse voltage, and the third driving signal remains the low-level signal; in a third time period subsequent to the second time period, the first driving signal remains to be the low-level signal, the second driving signal becomes a low-level signal, and the third driving signal becomes a high-level signal.

Optionally, the light emitting diode is an organic light emitting diode.

In another aspect, the present invention provides an AMOLED display panel comprising the GOA circuit described herein coupled to a matrix of pixels arranged in N rows, each row of pixels comprising a plurality of pixel circuits, each pixel circuit in one of the N rows being driven by one set of driving signals of the N sets of driving signals generated internally by the GOA circuit described herein combined with two common external voltages and a data voltage.

In another aspect, the present invention provides a method of driving a pixel circuit of an AMOLED display panel, comprising providing a current-source high-level voltage, a low-level voltage, a first external voltage, a second external voltage, and a data signal to the pixel circuit; and providing a first driving signal, a second driving signal, and a third driving signal from one stage of a gate driver on array (GOA) circuit to the pixel circuit, thereby driving the pixel circuit; wherein the GOA circuit comprises a plurality of GOA units cascaded in a multi-stage series of one GOA unit per stage and configured to generate at least two driving signals per stage with a timing arrangement for driving one row of pixel circuits of an AMOLED display panel, wherein the at least two driving signals in any stage include at least one output signals from a GOA unit of a present stage and at least one output signal from a GOA unit of a previous stage of the any stage.

Optionally, the pixel circuit comprises a first transistor having a drain being supplied with a current-source high-level voltage, a gate coupled to a first node, and a source coupled to a third node; a second transistor having a drain being supplied with a first fixed voltage, a gate coupled to a second control line, a source coupled to the first node; a third transistor having a drain being supplied with a data signal, a gate coupled to the second control line, and a source coupled to a second node; a fourth transistor having a drain coupled to the first node, a gate coupled to a third control line, and a source coupled to the second node; a fifth transistor having a drain being supplied with a second fixed voltage, a gate coupled to a first control line, and a source coupled to the third node; a first capacitor having a first terminal coupled to the second node and a second terminal coupled to the third node; a second capacitor having a first terminal coupled to the third node and a second terminal being supplied with a low-level voltage; and a light emitting diode having an anode coupled to the third node and a cathode being supplied with the low-level voltage; wherein the plurality of GOA units comprise N GOA units from a 1st GOA unit to a N-th GOA unit, each n-th stage GOA unit selected from the N GOA units, where N is integer greater than 2 and n varies from 1 to N, including a first power-supply terminal configured to receive a high-level power-supply voltage, a second power-supply terminal configured to receive a low-level power-supply voltage, and a clock signal terminal configured to receive a clock signal, an input terminal configured to receive an output signal from a GOA unit in one of previous stages as an input signal for the input terminal, a reset terminal configured to receive an output signal from a GOA unit in one of next stages as a reset signal for the reset terminal, a first output terminal configured to output a gate-driving signal, and a second output terminal configured to output a node voltage signal; the pixel circuit is connected to a n-th stage of the GOA circuit; the method comprising outputting the first driving signal of each n-th set of driving signals from the first output terminal of the (n−1)-th stage GOA unit to a first output line, except that the first driving signal being the start signal; outputting the second driving signal of each n-th set of driving signals from the first output terminal of the n-th stage GOA unit to a second output line; outputting the third driving signal of each n-th set of driving signals from the second output terminal of the n-th stage GOA unit to a third output line; coupling the first output line to the first control line to supply the first driving signal to the gate of the fifth transistor; coupling the second output line to the second control line to supply the second driving signal to the gates of the second transistor and the third transistor; coupling the third output line to the third control line to supply the third driving signal to the gate of the fourth transistor.

Optionally, both the first fixed voltage and the second fixed voltage are provided from an external source.

Optionally, the method further comprises applying a start signal and a set of clock signals to drive the GOA circuit; outputting the first driving signal from the first output terminal of the (n−1)-th stage GOA unit; outputting the second driving signal from the first output terminal of the n-th stage GOA unit; and outputting the third driving signal from the second output terminal of the n-th stage GOA unit.

Optionally, the method further comprises, in a first time period of a driving cycle, providing the first driving signal to the first control line as a high-level pulse voltage starting from a first time point in a first time period; providing the second driving signal to the second control line first as a low-level signal and as a high-level pulse voltage later at a second time point in the first time period; and providing the third driving signal to the third control line as a low-level signal in the first time period; in a second time period subsequent to the first time period, changing the first driving signal to a low-level signal to the first control line; keeping the second driving signal as the high-level pulse voltage to the second control line; and keeping third driving signal as the low-level signal to the third control line; in a third time period subsequent to the second time period, keeping the first driving signal as the low-level signal to the first control line; changing the second driving signal as a low-level signal to the second control line; and changing third driving signal as a high-level signal to the third control line.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

OLED luminance are extremely sensitive to the temporal instability and spatial non-uniformity of the TFTs which can result in Mura. One non-uniformity issue of the TFTs is caused by drifting of transistor threshold voltage Vth over time. For reducing or eliminating light emission non-uniformity issue caused by threshold voltage drift of TFTs, many designs for the AMOLED pixel circuits have been proposed, which usually include several control signals and fixed voltage signals being supplied from external signal lines beyond the basic gate-driving signal from a GOA unit and data signal for displaying image. These external signal lines must be laid on the display panel usually along its borders, thus demanding a wider frame in the display panel.

Figure 1:
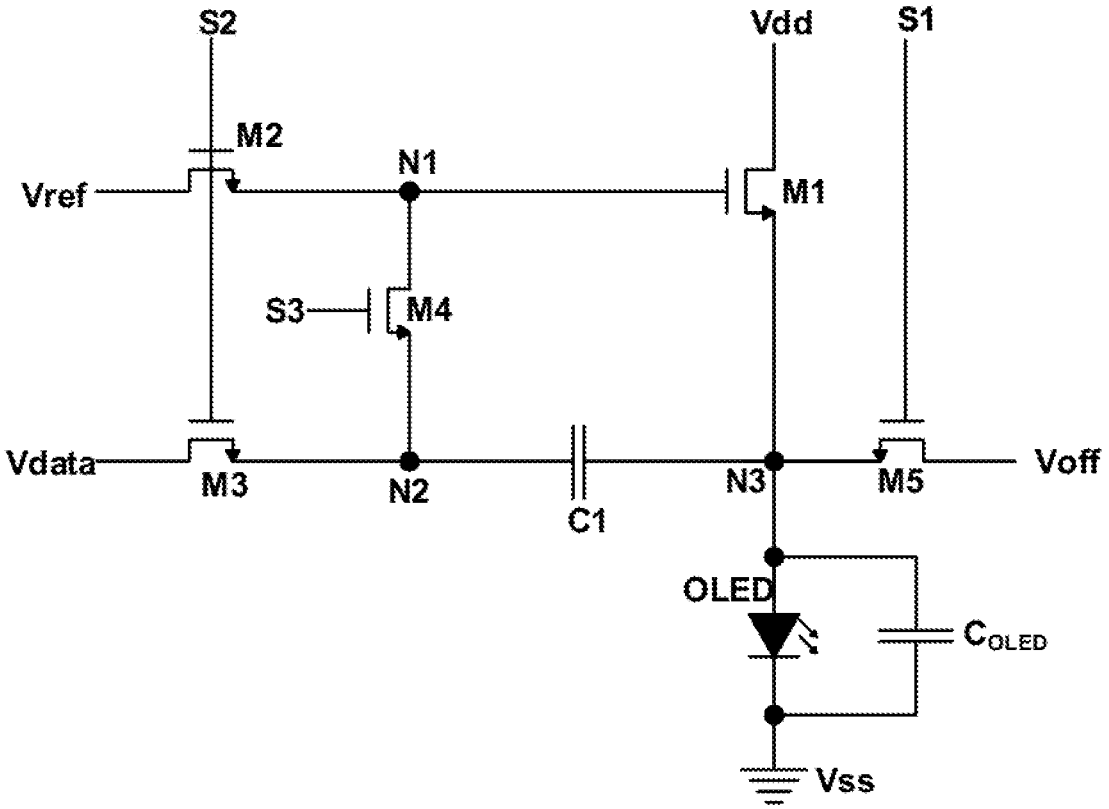
FIG. 1 Related Art
FIG. 1 is an exemplary circuit structure of an AMOLED pixel with transistor threshold voltage compensation function.

FIG. 1 shows an exemplary circuit structure of an AMOLED pixel with transistor threshold voltage compensation function. In the example, the AMOLED pixel circuit is a voltage-driven circuit including five transistors and two capacitors configured to receive three input signals S1, S2, and S3, a current-source voltage Vdd, three voltage-sources voltages Vref, Voff, and Vs, to drive a light emitting diode OLED to emit light based on a data signal Vdata. Referring to FIG. 1, a first transistor M1 has a gate connected to a first node N1, a drain connected to a first voltage line supplied with the voltage Vdd, and a source connected to a third node N3. The first transistor M1 is a driving transistor of the AMOLED pixel. Gates of a second transistor M2 and a third transistor M3 are commonly connected to a second signal line supplied with a second input signal S2. M2 has a drain connected to a second voltage line supplied with the voltage Vref and a source connected to the first node N1. M3 has a drain connected to a third voltage line supplied with the data signal Vdata and a source connected to a second node N2. A fourth transistor M4 has a gate connected to a fourth voltage line supplied with a third input signal S3, a drain and a source being respectively connected to the first node N1 and the second node N2. A fifth transistor M5 has a gate connected to a first voltage line supplied with a first input signal S1, a drain connected to a fifth voltage line supplied with the voltage Voff, and a source connected to the third node N3. Two terminals of the capacitor C1 are respectively connected to the second node N2 and the third node N3. Anode of the light emitting diode OLED is connected to the third node N3 and cathode of the OLED is connected to the sixth voltage line supplied with the voltage Vss. Another capacitor $C_{OLED}$ is coupled with the OLED electrically in parallel.

Figure 2:
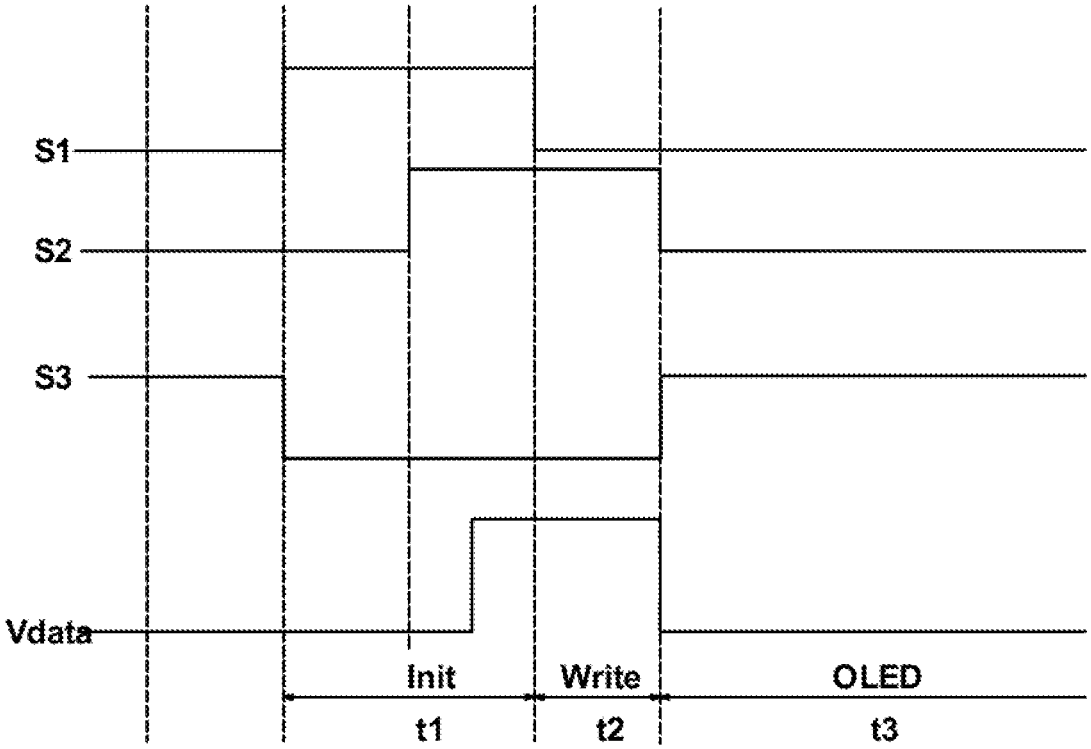
FIG. 2 Related Art
FIG. 2 is an exemplary timing waveform of multiple control signals for driving the AMOLED pixel circuit of FIG. 1 for light emission.

The AMOLED pixel circuit of FIG. 1 is configured to be operated for driving the OLED to emit light under a condition that the threshold voltage drift of the driving transistor M1 is compensated to prevent it to cause potential non-uniformity of light intensity from different pixels on an AMOLED display panel. FIG. 2 is an exemplary timing waveform of multiple control signals for driving the AMOLED pixel circuit of FIG. 1 for light emission. Referring to FIG. 2, the multiple control signals include at least the input signals S1, S2, S3 and the data signal Vdata.

The timing waveform is described to include three time periods in one operation cycle. In a first time period t1, which is an initialization period, the first input signal S1 is provided as a high-level signal starting from a first time point of t1, which turns the fifth transistor M5 on to allow the third node N3 to have a potential level of the voltage Voff. Then, at a second time point later than the first time point in the first time period t1, the second input signal is provided as a high-level signal, which turns on the second transistor M2 to allow the first node N1 to have a potential level of the voltage Vref. In the time period t1, the third input signal S3 is provided as a low-level signal so that the fourth transistor M4 is turned off.

The initialization period results in two nodes N1 and N3 at two fixed potential levels prepared for next period of threshold voltage compensation. A setup condition for this AMOLED pixel circuit is the voltage-source voltage Vss must be greater than the voltage Voff plus a value of the threshold voltage Vth of the driving transistor M1, i.e., Vss>Voff+|Vth|. Thus, in the time period t1, the OLED is reversely biased so that no light emission occurs.

A second time period t2 is a write period for providing data signal and making threshold voltage compensation. In time period t2, the first input signal S1 is a low-level signal and the second input signal S2 is a high-level signal. M2 and M3 are turned on. The third input signal S3 is a low-level signal so that M4 is turned off. Since the first node N1 has been set to the potential level of Vref and the third node N3 is set to the potential level of Voff, the gate-to-source voltage of the transistor M1 is Vref−Voff>|Vth|, so that M1 is in an on-state no matter the threshold voltage Vth is a positive voltage or a negative voltage. Thus, the third node N3 can be charged by the current source Vdd through the transistor M1 until the potential level of N3 reaches Vref−Vth. Again, since Vss>Vref+|Vth|, the OLED is still reversely biased and no light emission occurs. Now, the potential difference between two terminals of the capacitor C1 becomes V(N2)−V(N3)=Vdata−(Vref−Vth)=Vdata−Vref+Vth.

In a third time period t3, which is OLED light emission period, the third input signal S3 is a high-level signal to turn on the fourth transistor M4. The first and second input signals S1 and S2 are low-level signals so that M2, M3, and M5 are turned off. Because M4 is turned on, the potential level of one terminal of the capacitor C is applied to the gate of the first transistor M1. The gate-to-source voltage of M1 becomes Vgs=Vdata−Vref+Vth>Vth. Also, because the gate-to-source voltage Vgs minus the threshold voltage Vth is smaller than or equal to a drain-to-source voltage Vds, i.e., Vgs−Vth≤Vds, the transistor M1 should be in saturation state. Accordingly, its turn-on current can be expressed as $$I=k(Vgs-Vth)^2=k(Vdata-Vref+Vth-Vth)^2=k(Vdata-Vref)^2,$$

where k is a constant depended on process and geometry related parameters of the first transistor M1. This turn-on current, I, would be independent from the transistor threshold voltage Vth. As the turn-on current I passes the OLED to allow light emission, the light intensity of the OLED would be not affected by the threshold voltage drift thereby enhancing OLED light emission uniformity of the AMOLED display panel.

Figure 3:
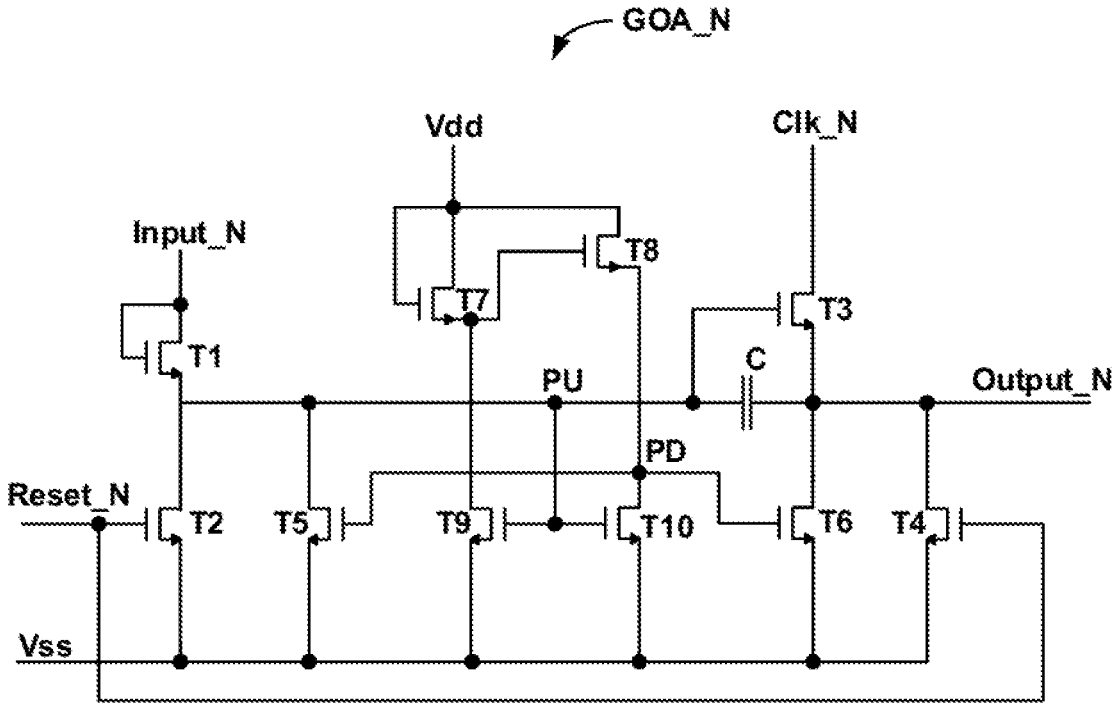
FIG. 3 Related Art
FIG. 3 is an exemplary circuit structure of a Gate Driver on Array (GOA) unit for generating a gate-driving signal used for driving the AMOLED pixel of FIG. 1.
Figure 4:
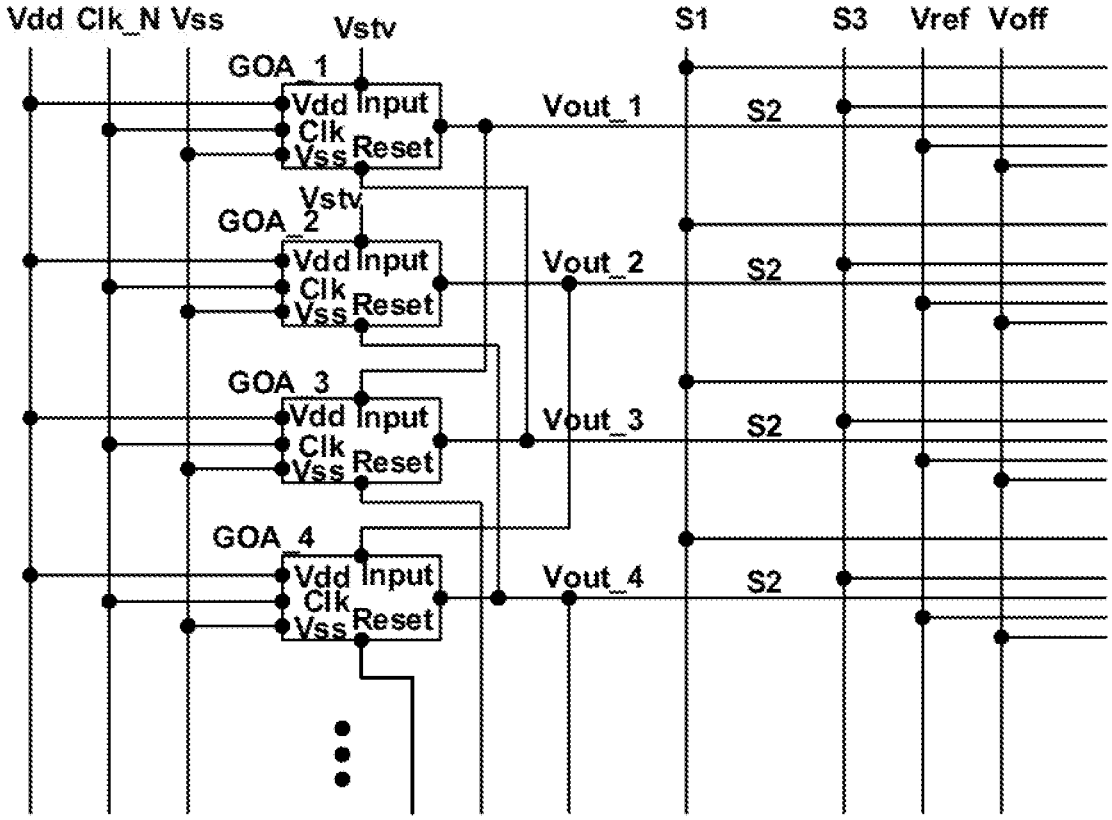
FIG. 4 Related Art
FIG. 4 is an exemplary circuit structure of a GOA circuit made by a plurality of GOA units of FIG. 3 cascaded in series.

Note, one of the input signal S2 used to drive the AMOLED pixel circuit is actually an output signal generated by a GOA unit in an active matrix of thin-film transistors based gate driver on array circuit of a typical AMOLED display panel. FIG. 3 is an exemplary circuit structure of a GOA unit for generating a gate-driving signal used for driving the AMOLED pixel of FIG. 1. Referring to FIG. 3, the GOA unit is a circuit including 10 transistors T1 through T10 and one capacitor C receiving voltage signal Vdd, clock signal Clk_N, and low-level voltage Vss. The circuit of GOA unit is configured to have an input terminal Input_N, an output terminal Output_N, and a reset terminal Reset_N. The Output_N terminal is configured to output a signal that is used as the second input signal S2 in the AMOLED pixel circuit of FIG. 1. Letter N here is used to denote the N-th stage GOA unit, (GOA_N). The GOA unit in FIG. 3 can be any one of a plurality of GOA units cascaded in multi-stage series of one-unit-per-stage in a GOA circuit. FIG. 4 shows an example of a typical GOA circuit including a plurality of GOA units cascaded in series. Each GOA unit at each stage in FIG. 4 can have a same circuit structure shown in FIG. 3.

Referring to FIG. 4, which is merely an example of many possible structures of GOA units cascaded in series. In particular, the GOA circuit includes a N−2 input configuration and a N+2 reset configuration using one or more clock signals respectively provided to a sub-set of GOA units time-sequentially. The first stage GOA unit receives an input signal Vstv externally and a reset signal internally from the Output_3 terminal of the third stage GOA unit, and outputs an output signal Vout_1. The second stage GOA unit receives an input signal Vstv again and a reset signal internally from the Output_4 terminal of the fourth stage GOA unit, and outputs an output signal Vout_2. For N>2, a N-th stage GOA unit receives an input signal internally from the Output_N−2 terminal of the (N−2)-th stage GOA unit in the series and receives a reset signal internally from the Output_N+2 terminal of the (N+2)-th stage GOA unit in the series, and output an output signal Vout_N.

Regarding the signal line setup, each GOA unit is associated with some input signal lines receiving a high-level power-supply voltage Vdd, a clock signal Clk_N, and a low-level power-supply voltage Vss. Optionally, the clock signal Clk_N is one of a set of J clock signals. The plurality of GOA units can be divided into multiple groups with each group containing J consecutive stages of GOA units. The set of J clock signals, from 1 through J, are provided sequentially and respectively to J GOA units of a group and sequentially from one group to next group. For example, in FIG. 4, J=4. The 4 clock signal lines can be shared by every group of the cascaded series. The signal lines receiving Vdd and Vss can be shared by every GOA unit in the cascaded series.

Other than the single output signal Vout_N outputted from the Output_N terminal per each N-th stage GOA unit, which is used as an input signal S2 for driving the AMOLED pixel, two additional signals S1 and S3 and two voltages Vref and Voff are still needed to combine with the signal S2 for driving the AMOLED pixel circuit of FIG. 1. Each of these signals need separate conduction line to be laid out to receive signals or voltages from external sources. Some signals are not DC signals and may have to be provided by special integrated driving circuits. These external signal lines require extra layout space on the display panel, making it extremely difficult to make a narrow-border or borderless display panel.

Accordingly, the present invention provides, inter alia, a gate driver on array (GOA) circuit, an AMOLED display apparatus having the same, an AMOLED pixel driven by the GOA circuit and a driving method thereof that substantially obviate one or more of the problems due to limitations and disadvantages of the related art. In one aspect, the present disclosure provides a GOA circuit. In some embodiments, the GOA circuit includes a plurality of GOA units cascaded in a multi-stage series of one GOA unit per stage and configured to generate at least two (e.g., three) driving signals per stage with a timing arrangement for driving one row of pixel circuits of an AMOLED display panel, wherein the at least two (e.g., three) driving signals in any stage include at least one (e.g., two) output signals from a GOA unit of a present stage and at least one (e.g., one) output signal from a GOA unit of a previous stage of the any stage.

Figure 5:
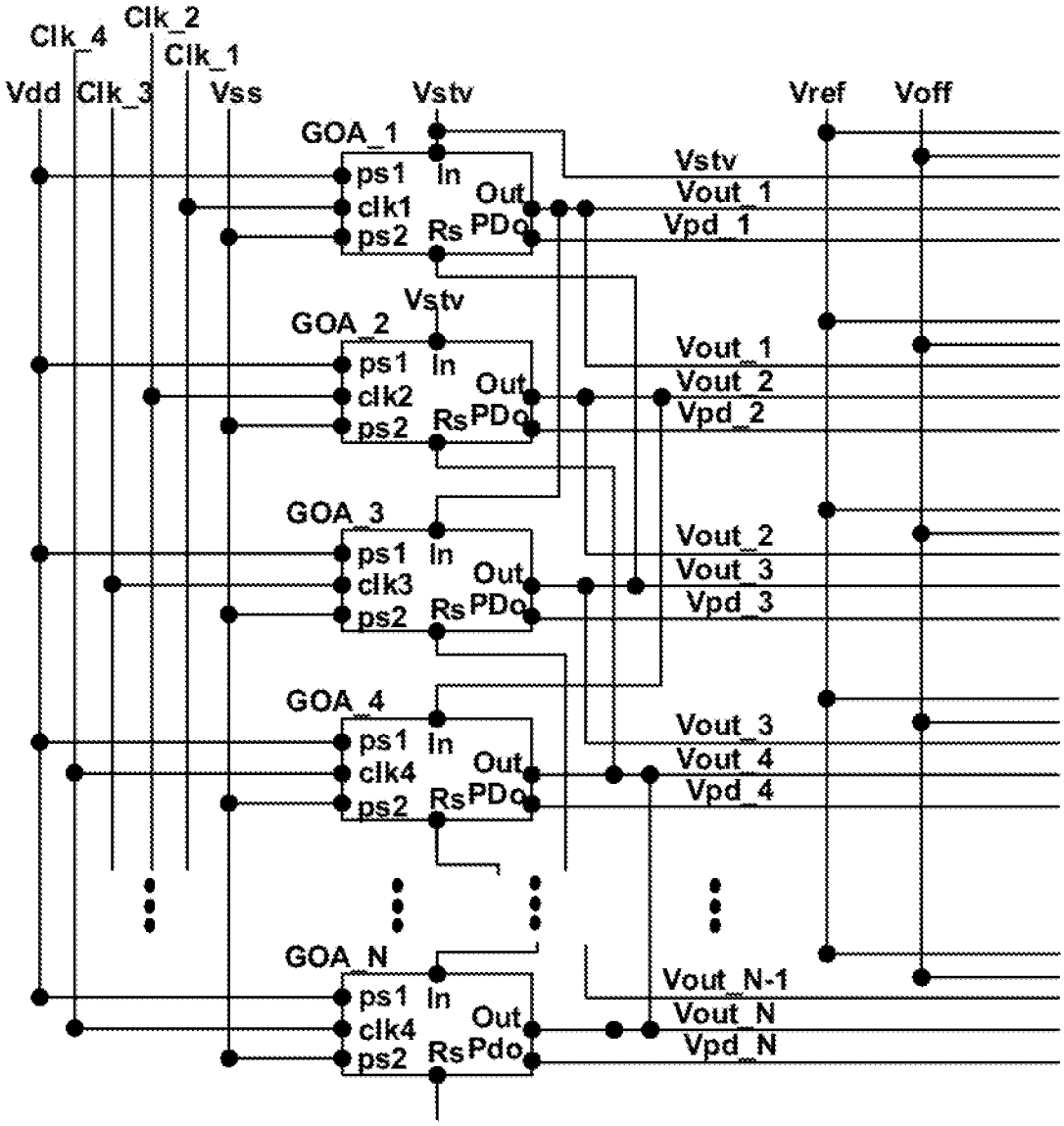
FIG. 5 is a GOA circuit according to some embodiments of the present disclosure.
Figure 7:
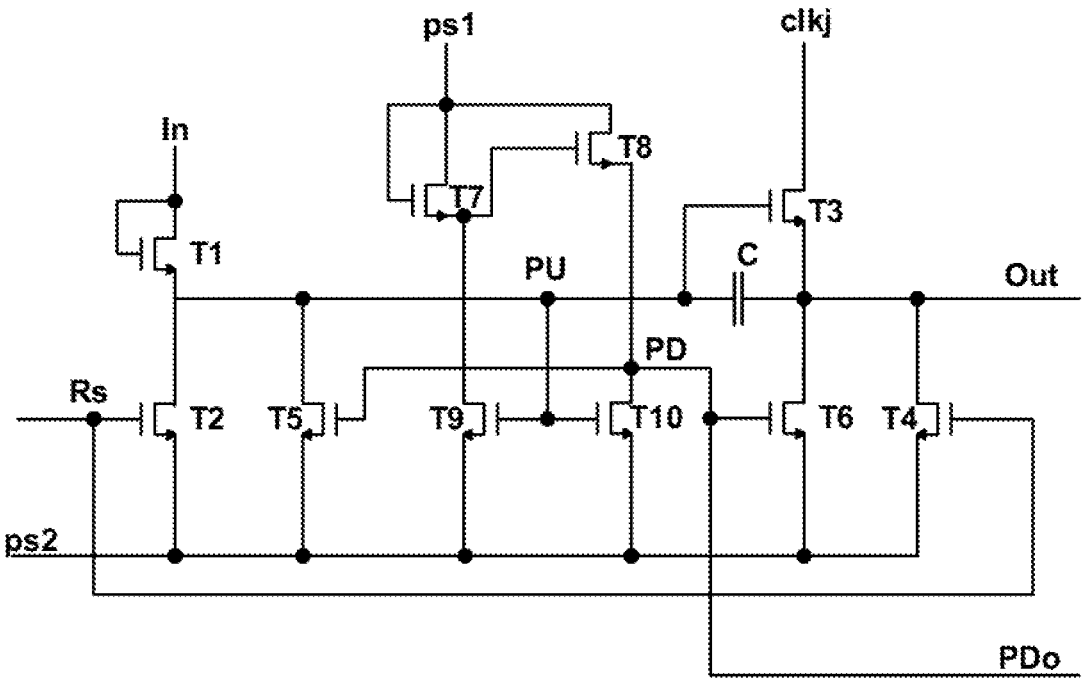
FIG. 7 is a circuit structure of a GOA unit in the GOA circuit of FIG. 5 according to some embodiments of the present disclosure.

In one aspect, a GOA circuit is designed to provide extra driving signals required for driving an AMOLED pixel circuit so that the number of external signal lines in an AMOLED display panel is reduced. FIG. 5 is a GOA circuit according to some embodiments of the present disclosure. The GOA circuit includes a plurality of GOA units cascaded through a multi-stage internal input/reset configuration in series with each GOA unit being driven by some external driving signals to generate at least two output signals. In an embodiment, the GOA circuit of FIG. 5 is formed by cascading N GOA units in multi-stage series of one-unit-per-stage from a 1st stage GOA unit GOA_1 to a N-th stage GOA unit GOA_N to generate respective N sets of driving signals to be used for respectively controlling light emissions of N rows of a matrix of pixels of the AMOLED display panel. Any one of the N GOA units may be denoted as an n-th stage GOA unit, where N is integer depended on pixel resolution of the display panel and n varies from 1 to N. Each GOA unit, as shown in FIG. 7 below, includes a first power-supply terminal ps1, a second power-supply terminal ps2, a clock signal terminal clkj (where j may varies from 1 to J, J is an integer >1), an input terminal In, a reset terminal Rs, a first output terminal Out, and a second output terminal PDo.

More specifically, referring to FIG. 5, the first power-supply terminal ps1 is connected to a first voltage line that is supplied with a high-level voltage signal Vdd. The second power-supply terminal ps2 is connected to a second voltage line that is supplied with a low-level voltage signal Vss. The first voltage line and the second voltage line are commonly shared by all GOA units in the cascaded series. Both voltage signals Vdd and Vss are supplied through external voltage lines from an external controller and shared by all GOA units of the GOA circuit. External means outside the display panel layout region. The controller may be provided as an IC chip or module disposed next to the display panel.

In an embodiment, the N GOA units may be divided into M groups in series and each group includes J GOA units consecutively cascaded in series. M and J are integer. M×J=N. FIG. 5 shows an example of J=4. Other alternative configurations are possible, for example, J can be 6 associated with 6 clock signals. Each of the 4 GOA units in a group has one clock signal terminal clkj separately connected to one clock signal line supplied with a clock signal Clk_j, where j varies from 1 to J. For example, terminal clk1 of GOA_1 connects a first clock signal line supplied with clock signal Clk_1. Similarly, terminal clk2, clk3, and clk4 is respectively connected to a second, third, and fourth clock signal line supplied with Clk_2, Clk_3, and Clk_4. GOA units from different group of the M groups (of the N GOA units cascaded in series) have their clock signal terminals respectively connected to the same four clock signal lines.

Figure 6:
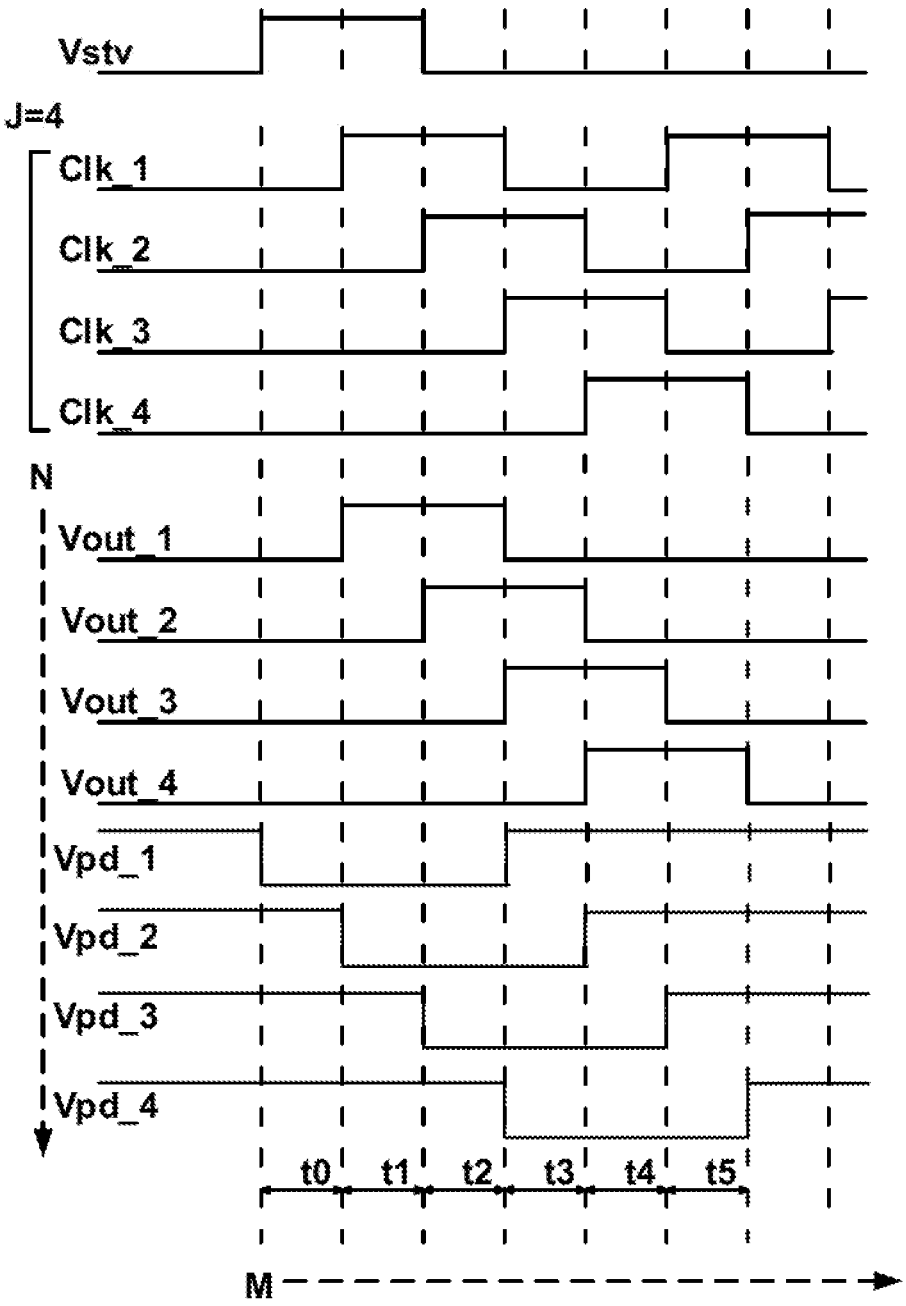
FIG. 6 is a timing waveform of multiple control signals for operating the GOA circuit of FIG. 5 according to some embodiments of the present disclosure.

FIG. 6 is a timing waveform of multiple control signals for operating the GOA circuit of FIG. 5 cascaded in series according to some embodiments of the present disclosure. Referring to FIG. 6, the four clock signals Clk_1, Clk_2, Clk_3, and Clk_4 are provided from the external controller in time-sequential manner to the 4 GOA units in a group with a time-delay for any clock signal relative to a previous adjacent clock signal. Further, the same four clock signals are respectively outputted to four GOA units of a next group. The above clock signal timing pattern continues until a last clock signal Clk_4 is outputted to a last or 4-th GOA unit of the last or M-th group.

In an embodiment, the GOA circuit is configured such that the N GOA units are cascaded in a (n−2) input configuration combined with a (n+2) reset configuration in the series. In particular, the input terminal In of each n-th GOA unit is connected via an internal signal line to the first output terminal Out of the (n−2)-th GOA unit in the series to receive the output signal Vout_n−2 as an input signal for the n-th GOA unit. The reset terminal of the n-th GOA unit is then connected via another internal signal line to the first output terminal Out of the (n+2)-th GOA unit in the series to receive the output signal Vout_n+2 as a reset signal for the n-th GOA unit. For each of first two GOA units (GOA_1 and GOA_2) in the series, the input terminal In is configured to receive a start signal externally from the controller.

In an embodiment, referring to FIG. 5, the first output terminal Out of each n-th GOA unit is connected to an output signal line for outputting a first driving signal Vout_n. The second output terminal PDo of each n-th GOA unit is connected to another output signal line for outputting a second driving signal Vpd_n. Note, any driving signal mentioned here is referred to be a high-level pulse voltage being outputted at a certain time period and a low-level signal being outputted at certain alternative time period depending on certain timings relative to other driving signals in a set of multiple driving signals for achieving a control purpose.

Referring to FIG. 6, both the first output signal Vout_n and the second output signal Vpd_n are generated according to a timing set by the corresponding one of J clock signals Clk_j (j=1, 2, 3, 4) in one of M groups of the N GOA units in the GOA circuit of FIG. 5. According to the timing waveform of FIG. 6, the four clock signals Clk_1, Clk_2, Clk_3, and Clk_4 are sequentially provided with the time-delay from the first clock signal Clk_1 to the fourth clock signal Clk_4 respectively to four GOA units in each group, four first output signals Vout_1, Vout_2, Vout_3, and Vout_4 are generated respectively by the four GOA units in the group sequentially in time in-phase with those four clock signals. Vout_1 has a rising edge at the start of the time period t1, Vout_2 has a rising edge at the start of next time period t2, Vout_3 has a rising edge at the start of next time period t3, and Vout_4 has a rising edge at the start of next time period t4. Following this timing set by the four clock signals Clk_1, Clk_2, Clk_3, and Clk_4, four second output signals Vpd_1, Vpd_2, Vpd_3, and Vpd_4 are also generated respectively by the four GOA units with certain time-delay relative to corresponding four first output signals Vout_1, Vout_2, Vout_3, and Vout_4. In particular, the rising edges of the four second output signals are respectively in-phase with four falling edges of the first output signals Vout_1, Vout_2, Vout_3, and Vout_4. This pattern will iterate through rest of series of M groups of GOA units. In general, the first output signal Vout_n of the n-th GOA unit is a time-delay behind the first output signal Vout_n−1 of the (n−1)-th GOA unit and the second output signal Vpd_n becomes a high-level signal when the first output signal Vout_n becomes a low-level signal.

FIG. 7 is a circuit structure of a GOA unit in the GOA circuit of IG. 5 according to some embodiments of the present disclosure. The circuit structure of GOA unit in FIG. 7 is substantially similar to that of GOA unit in FIG. 3, including 10 transistors T1 through T10 and 1 capacitor C, configured with an input terminal In, a reset terminal Rs, a clock signal terminal clkj, a first power-supply terminal ps1, a second power-supply terminal ps2, a first output terminal Out, and a second output terminal PDo, including at least a pull-up node PU and a pull-down node PD. The input, reset, power-supply, or clock signals of the GOA unit are supplied according to signal line configurations shown in FIG. 5 and signal timing defined in FIG. 6. Compared to the circuitry provided in FIG. 3, the GOA unit of FIG. 7 is distinct by providing not only a first output terminal Out which outputs a gate-driving signal as the first output signal Vout_n but also a second output terminal PDo connected from the pull-down node PD thereof which outputs a node voltage signal as the second output signal Vpd_n. Referring to FIG. 5, total N GOA units of the GOA circuit are configured with a multi-stage output configuration to provide respective N sets of driving signals to be used for controlling light emissions of a matrix of pixels of the AMOLED display panel. Each set of driving signals includes at least two (e.g., three) driving signals. In an alternative view of the output configuration, each of the N GOA units is associated with at least two (e.g., three) output signal lines respectively for providing at least two (e.g., three) driving signals to each AMOLED pixel circuit in one row of a matrix of pixels in the AMOLED display panel. A first output signal line associated with each n-th GOA unit is configured to provide a first driving signal that is the first output signal Vout_n−1 from the first output terminal of the (n−1)-th GOA unit. A second output signal line associated with the n-th GOA unit is configured to provide a second driving signal that is the first output signal Vout_n from the first output terminal of the n-th GOA unit. The third output signal line associated with the n-th GOA unit is configured to provide a third driving signal that is the second output signal Vpd_n from the second output terminal of the n-th GOA unit. An exception of the multi-stage output configuration is that the first output signal line associated with the first GOA unit is configured to directly pas the start signal Vstv as the first driving signal.

Further comparing the GOA circuit of the present disclosure (FIG. 5) with the GOA circuit shown in FIG. 4, the GOA circuit of FIG. 5 is advantageously configured to provide not only one driving signal Vout_n but also two additional driving signals per each stage in the multi-stage cascaded series of the GOA circuit. A first additional driving signal is Vout_n−1 drawn from the first output terminal of an adjacent previous-stage GOA unit in the series. A second additional driving signal is Vpd_n drawn from the second output terminal of the current-stage GOA unit in the series. The two additional driving signals are generated internally by the GOA circuit of FIG. 5 unlike the two signals S1 and S3 of FIG. 4 which are not generated by the GOA circuit but drawn respectively from two external signal lines. Therefore, as these driving signals, i.e., Vout_n−1, Vout_n, and Vpd_n, are provided through internal signal lines to an AMOLED pixel circuit (to be shown below), at least two external signal lines can be eliminated.

Figure 8:
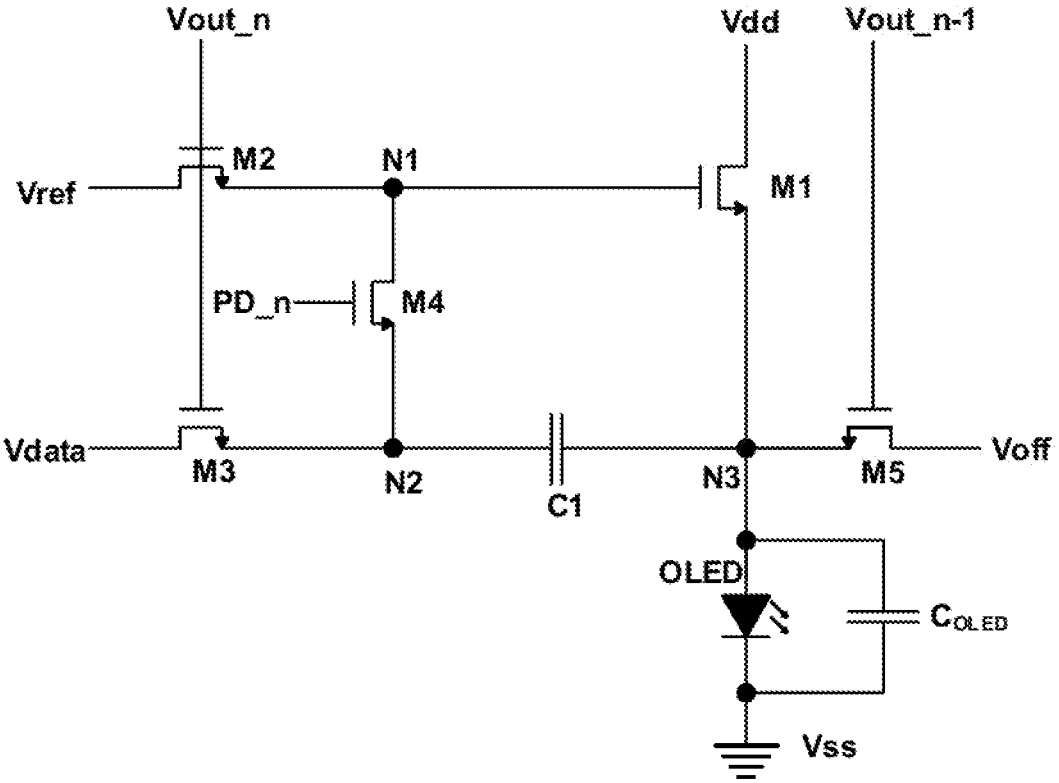
FIG. 8 is a circuit structure of an AMOLED pixel driven by the GOA circuit of FIG. 5 according to some embodiments of the present disclosure.

FIG. 8 is a circuit structure of an AMOLED pixel driven by the GOA circuit of FIG. 5 according to some embodiments of the present disclosure. The circuit structure of the AMOLED pixel is substantially the same as that of FIG. 1 including five transistors, M1 through M5, and two capacitors, C1 and $C_{OLED}$, supplied with a current-source voltage Vdd, three voltage-sources voltages Vref, Voff, and Vss and driven by three driving signals to control a light emitting diode OLED to emit light based on a data signal Vdata. The AMOLED pixel disclosed in FIG. 8 is distinct from traditional pixel circuit of FIG. 1 by replacing two external driving signals S1 and S3 with two internal driving signals from a same GOA circuit that provides the remaining driving signal S2. Signal S1 is replaced by the first driving signal Vout_n−1 and signal S3 is replaced by the third driving signal Vpd_n. signal S2 remains the same one drawn from the second driving signal Vout_n, all being generated as one set of driving signals per each GOA unit of the GOA circuit of FIG. 5.

Figure 9:
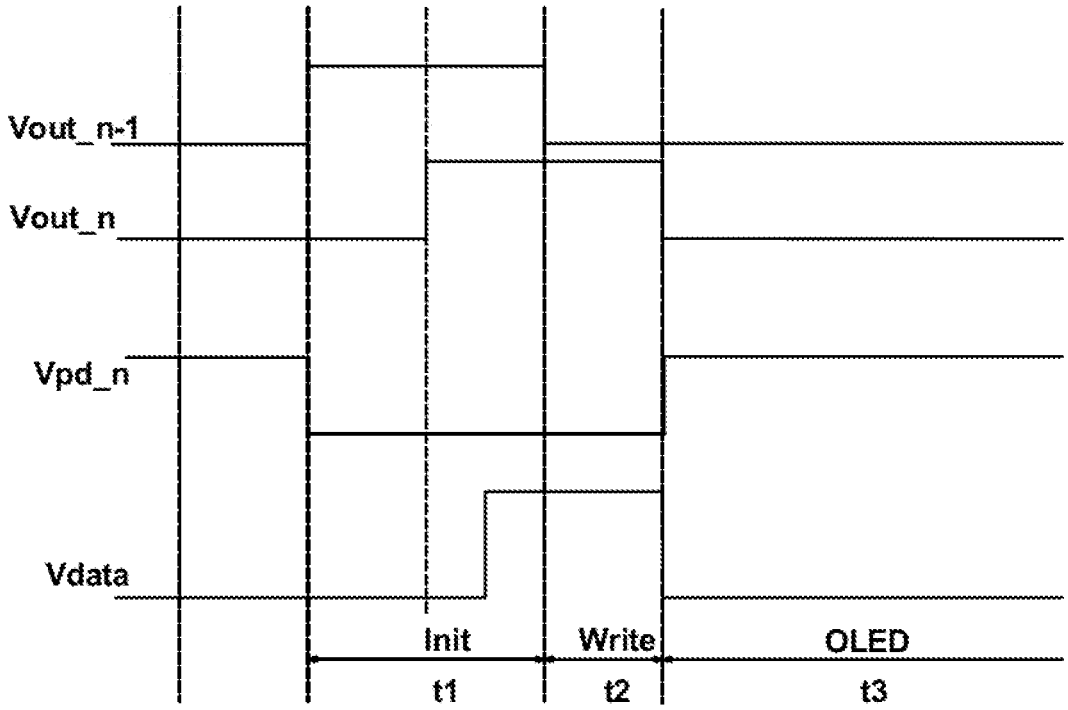
FIG. 9 is a timing waveform for operating the AMOLED pixel of FIG. 8 according to some embodiments of the present disclosure.

FIG. 9 is a timing waveform for operating the AMOLED pixel of FIG. 8 according to some embodiments of the present disclosure. The timing waveform is substantially the same as that of FIG. 2 except that the three driving signals S1, S2, and S3 are replaced by Vout_n−1, Vout_n, and Vpd_n fully generated internally by a GOA circuit for any n-th row AMOLED pixel circuits in a matrix of pixels of an AMOLED display panel. Note, specially for driving the first row of pixel circuits, the first driving signal should be directly the start signal Vstv.

Referring to the GOA unit shown in FIG. 7 and corresponding timing waveform shown in FIG. 6, the generation of a set of three driving signals by the GOA circuit of FIG. 5 for driving the AMOLED pixel of FIG. 8 based on the timing of FIG. 9 can be illustrated in more details. In fact, each set of driving signals is applied to drive all AMOLED pixel circuits in one row of matrix of pixels in the AMOLED display panel. For simplification, only one AMOLED pixel circuit is referred and shown in FIG. 8.

In period t0 (FIG. 6), which is a precharge period for the first GOA unit GOA_1 in the cascaded series, an input signal Vstv is provided to the input terminal In of the first GOA unit GOA_1 (FIG. 7) with a high-level signal. Transistor T1 is turned on to pull up the pull-up node PU to a high-level voltage. Accordingly, transistors T3, T9, and T10 are turned on. The potential levels of the source of transistor T7 and the gate of transistor T8 are all pulled down to that of the low-level voltage Vss. The pull-down node PD is also pulled down to the low-level voltage Vss. In this period, Vstv is transmitted as a first driving signal of a first set of driving signals for the AMOLED pixel circuit (FIG. 8) to turn on transistor M5. M5 is on so that the fixed voltage Voff is written to node N3 (FIG. 8).

In period t1 (FIG. 6), Vstv and Clk_1 are supplied as high-level signals. The first GOA unit GOA_1 generates a gate-driving signal Vout_1 outputted via the first output terminal Out as a second driving signal received by the AMOLED pixel circuit (FIG. 8). The timing of the first driving signal Vstv relative to the second driving signal Vout_1 is exactly the same as the signal S1 relative to signal S2 in FIG. 3. The second driving signal Vout_1 as a high-level signal turns on transistors M2 and M3 so that potential level at node N1 is set to that of the fixed voltage Vref and potential level at node N2 is set to that of data signal Vdata. At this time, all AMOLED pixel circuits in one row are initialized in terms of setting respective potential levels for the nodes N1, N2, and N3. After initialization, transistor M1 is turned on to be prepared for charging the node N3. The high-level signal of Vout_1 is also inputted as the input signal for the third GOA unit GOA_3, which pulls up potential level at corresponding pull-up node PU high to start the precharge period for the third GOA unit GOA_3.

In period t2, the first clock signal Clk_1 remains a high-level signal, still leading the Vout_1 to the high-level signal. Vstv changes to a low-level to turn off M5. Transistors M2 and M3 in the AMOLED pixel circuit are kept on. Node N2 is given the potential level of the data signal Vdata. Node N3 is charged through transistor M1 to make the potential level of N3 to reach Vref−Vth, where Vth is a threshold voltage of the transistor M1. For every pixel circuits in the one row, the potential difference between node N2 and node N3 can be expressed as $V_{N2}-V_{N3}$=Vdata−(Vref−Vth)=Vdata−Vref+Vth. In this period, the second clock signal Clk_2 is supplied as a high-level signal, the pull-up node PU of the second GOA unit GOA_2 that was pulled up by Vstv in period t1 still allows the Vout_2 to be outputted as a high-level signal in-phase with the second clock signal Clk_2. The potential level of the node PU of the third GOA unit remains high.

In period t3, GOA unit performs reset and OLED in the AMOLED pixel circuit is driven to emit light. The third clock signal Clk_3 becomes a high-level signal. As a result, the third GOA unit GOA_3 outputs Vout_3 as a high-level signal. Based on FIG. 5, the Vout_3 is used as the reset signal for the first GOA unit GOA_1. Then transistors T2 and T4 of GOA_1 are turned on, pulling down the potential level of the pull-up node PU as well as the output, i.e., Vout_1 to the low-level voltage Vss. At the same time, the pull-down node PD of the GOA_1 is pushed up to a high-level voltage which is outputted via terminal PDo as a third driving signal Vpd_1 received by the AMOLED pixel circuit (FIG. 8). Vpd_1 turns on transistor M4 making $V_{N2}=V_{N1}$, so that gate-to-source voltage of M1 Vgs=$V_{N1}-V_{N3}$=Vdata−Vref+Vth. The OLED is on as the turn-on current I=k(Vdata−Vref)$^2$ passes through to induce light emission with threshold voltage of M1 being substantially compensated. The voltage level and timing of the third driving signal Vpd_1 is able to allow the OLED in light-emission state the same way as the applied external signal S3, shown in FIG. 3.

Therefore, it just proven that the three driving signals Vstv, Vout_1, and Vpd_1 from the first GOA unit used to drive the first row of AMOLED pixel circuits in an AMOLED display panel are fully compatible in timing requirement set in FIG. 9. Similarly, per each n-th GOA unit, three driving signals Vout_n−1, Vout_n, and Vpd_n are fully compatible in timing for driving the n-th row of AMOLED pixel circuits in the AMOLED display panel. The external signal lines used for providing two driving signals S1 and S3 are no longer required.

In another aspect, the present disclosure provides a pixel circuit of an AMOLED display panel configured to be driven by at least two (e.g., three) driving signals with a timing including a first driving signal, a second driving signal, and a third driving signal generated from one stage of the GOA circuit of the present disclosure formed by cascading N GOA units in a multi-stage series. The one stage of GOA circuit is correspondingly for driving one row of pixel circuits. Any pixel circuit in a row receives the same at least two (e.g., three) driving signals of a corresponding stage. Per any n-th stage GOA unit in the multi-stage series of the GOA circuit, the first driving signal of the at least two (e.g., three) driving signals is a first output signal of the previous (n−1)-th stage GOA unit, the second driving signal of the at least two (e.g., three) driving signals is a first output signal of the current n-th stage GOA unit, and the third driving signal of the at least two (e.g., three) driving signals is a second output signal of the current n-th stage GOA unit.

In an embodiment, the at least two (e.g., three) driving signals are provided with the timing based on a driving cycle of each pixel (for a line of image). In a first time period of the driving cycle, the first driving signal is provided as a high-level pulse voltage starting from a first time point, the second driving signal is provided as a low-level signal first and as a high-level pulse voltage until a second time point in the first time period later in time relative to the first time point. The third driving signal is provided as a low-level signal. In a second time period subsequent to the first time period, the first driving signal becomes a low-level signal, the second driving signal remains to be the high-level pulse voltage, and the third driving signal remains the low-level signal. In a third time period subsequent to the second time period, the first driving signal remains to be the low-level signal, the second driving signal becomes a low-level signal, and the third driving signal becomes a high-level signal.

The pixel circuit is supplied with a first external voltage Vref, a second external voltage Voff, and a data signal Vdata. The pixel circuit, as shown in FIG. 8, includes a first transistor M1 having a drain being supplied with a current-source high-level voltage Vdd, a gate coupled to a first node N1, and a source coupled to a third node N3. The pixel circuit includes a second transistor M2 having a drain being supplied with the first external voltage Vref, a gate received the second driving signal based on the timing, a source coupled to the first node N1. The pixel circuit further includes a third transistor M3 having a drain being supplied with the data signal Vdata based on the timing, a gate receiving the second driving signal, and a source coupled to a second node N2. The pixel circuit also includes a fourth transistor M4 having a drain coupled to the first node N1, a gate receiving the third driving signal based on the timing, and a source coupled to the second node N2. Additionally, the pixel circuit includes a fifth transistor M5 having a drain being supplied with the second external voltage Voff, a gate receiving the first driving signal based on the timing and a source coupled to the third node N3. The pixel circuit further includes a first capacitor C1 having a first terminal coupled to the second node N2 and a second terminal coupled to the third node N3. Furthermore, the pixel circuit includes a second capacitor $C_{OLED}$ having a first terminal coupled to the third node N3 and a second terminal being supplied with a low-level voltage Vss. Moreover, the pixel circuit includes a light emitting diode having an anode coupled to the third node N3 and a cathode being supplied with the low-level voltage Vss. The light emitting diode is an organic light emitting diode (OLED).

In yet another aspect, the present disclosure provides an AMOLED display panel including a GOA circuit coupled to a matrix of pixels arranged in N rows, each row of pixels comprising a plurality of pixel circuits of FIG. 8. Each of the plurality of pixel circuits in one of the N rows being driven by one set of driving signals of the N sets of driving signals with a proper timing generated internally by the GOA circuit combined with two common external voltages and a data voltage.

In still another aspect, the present disclosure provides a display apparatus having an AMOLED display panel described herein. Examples of appropriate display apparatuses include, but are not limited to, an electronic paper, a mobile phone, a tablet computer, a television, a monitor, a notebook computer, a digital album, a GPS, etc.

In yet still another aspect, the present disclosure provides a method for driving a AMOLED pixel circuit. The method includes providing the AMOLED pixel of FIG. 8 and forming the GOA circuit including N GOA units cascaded from 1 to N in series for outputting respectively N sets of driving signals. The method further includes outputting a first driving signal of each n-th set of driving signals of the N sets of driving signals from the first output terminal of the (n−1)-th stage GOA unit to a first output line, except that the first driving signal being the start signal for outputting at least two (e.g., three) driving signals per each GOA unit. Additionally, the method includes outputting a second driving signal of each n-th set of driving signals from the first output terminal of the n-th stage GOA unit to a second output line. The method further includes outputting a third driving signal of each n-th set of driving signals from the second output terminal of the n-th stage GOA unit to a third output line. Furthermore, the method includes coupling the first output line to the first control line to supply the first driving signal to the gate of the fifth transistor. The method also includes coupling the second output line to the second control line to supply the second driving signal to the gates of the second transistor and the third transistor. Moreover, the method includes coupling the third output line to the third control line to supply the third driving signal to the gate of the fourth transistor.

In a specific embodiment, the method includes applying a start signal and a set of clock signals for driving the GOA circuit to generate the first driving signal, the second driving signal, and the third driving signal in a timing that meets a requirement for driving a pixel circuit. In a first time period of the timing, the first driving signal is provided as a high-level pulse voltage starting from a first time point, the second driving signal is provided as a low-level signal first and as a high-level pulse voltage from a second time point in the first time period later in time relative to the first time point, the third driving signal is provided as a low-level signal. In a second time period of the timing subsequent to the first time period, the first driving signal becomes a low-level signal, the second driving signal remains to be the high-level pulse voltage, and the third driving signal remains the low-level signal. In a third time period of the timing subsequent to the second time period, the first driving signal remains to be the low-level signal, the second driving signal becomes a low-level signal, and the third driving signal becomes a high-level signal.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A gate driver on array (GOA) circuit comprising a plurality of GOA units cascaded in a multi-stage series of one GOA unit per stage and configured to generate at least two driving signals per stage with a timing arrangement for driving one row of pixel circuits of an AMOLED display panel, wherein driving signals for driving any one row of pixel circuits include at least one output signals from a GOA unit of a present stage and at least one output signal from a GOA unit of a previous stage;

wherein the plurality of GOA units comprise:

N GOA units from a 1st GOA unit to a N-th GOA unit, each n-th stage GOA unit selected from the N GOA units, where N is integer greater than 2 and n varies from 1 to N, including a first power-supply terminal configured to receive a high-level power-supply voltage, a second power-supply terminal configured to receive a low-level power-supply voltage, and a clock signal terminal configured to receive a clock signal, an input terminal configured to receive an output signal from a GOA unit in one of previous stages as an input signal for the input terminal, a reset terminal configured to receive an output signal from a GOA unit in one of next stages as a reset signal for the reset terminal, a first output terminal configured to output a gate-driving signal, and a second output terminal configured to output a node voltage signal;

wherein the input terminal of the n-th stage GOA unit is configured to receive an output signal from a (n−2)-th stage GOA unit as the input signal; and the reset terminal of the n-th stage GOA unit is configured to receive an output signal from a (n+2)-th stage GOA unit as the reset signal.

2. The GOA circuit of claim 1, wherein driving signals in the n-th stage, where 2<n≤N, include a first driving signal, a second driving signal, and a third driving signal;

the first driving signal is a gate-driving signal from the first output terminal of a (n−1)th stage GOA unit;

the second driving signal is the gate-driving signal from the first output terminal of the n-th stage GOA unit; and the third driving signal is the node voltage signal from the second output terminal of the n-th stage GOA unit.

3. The GOA circuit of claim 2, wherein the first driving signal of the n-th stage is a high-level pulse voltage with a first rising edge in a first time point of a first time period of a pixel-driving cycle, the first driving signal of the n-th stage being in-phase with a clock signal supplied to a (n−1)-th stage GOA unit;

the second driving signal of the n-th stage is a high-level pulse voltage with a second rising edge in a second time point of the first time period, the second driving signal of the n-th stage being in-phase with a clock signal supplied to the n-th stage GOA unit, the second time point being later in time relative to the first time point; and the third driving signal of the n-th stage is a low-level signal during the first time period, the third driving signal being the same as a voltage at a pull-down node of the n-th stage GOA unit.

4. The GOA circuit of claim 3, wherein the first driving signal becomes a low-level signal at a third time point at which the first time period ends and a second time period of the pixel-driving cycle starts, the third time point being later in time relative to the second time point;

the second driving signal remains to be the high-level pulse voltage in the second time period; and the third driving signal remains to be the low-level signal during the second time period.

5. The GOA circuit of claim 4, wherein the first driving signal remains to be the low-level signal in a third time period of the pixel-driving cycle, the third time point being later in time relative to the second time point;

the second driving signal becomes a low-level signal at a fourth time point at which the second time period ends and the third time period starts; and the third driving signal becomes a high-level signal at the fourth time point and remains to be the high-level signal in the third time period.

6. The GOA circuit of claim 1, wherein input terminals of a 1st stage GOA unit and a 2nd stage GOA unit of the N GOA units are configured to receive a start signal provided by a controller as input signals respectively for the 1st stage GOA unit and the 2nd stage GOA unit; and driving signals of a 1st-stage includes a first driving signal, a second driving signal, and a third driving signal;

the first driving signal is the start signal;

the second driving signal is a gate-driving signal from the first output terminal of a 1st-stage GOA unit; and the third driving signal is the node voltage signal from the second output terminal of the 1st-stage GOA unit.

7. The GOA circuit of claim 6, wherein the N GOA units cascaded in series comprises M groups of GOA units cascaded in series, each of the M groups of GOA units including J GOA units cascaded in series, wherein M and J are integers, and M*J=N.

8. The GOA circuit of claim 7, further comprising a first external voltage line providing the start signal, a second external voltage line connected commonly to the first power-supply terminal of each of the N GOA units to supply the high-level power-supply voltage, a third external voltage line connected commonly to the second power-supply terminal of each of the N GOA units to supply the low-level power-supply voltage, and J clock signal lines respectively connected to clock signal terminals of J GOA units in each of the M groups to respectively provide J clock signals.

9. The GOA circuit of claim 8, wherein the J clock signals are provided sequentially from a 1st clock signal to a J-th clock signal with a time-delay for any subsequently next clock signal, the 1st clock signal being provided with the time-delay relative to the start signal.

10. The GOA circuit of claim 9, wherein the time-delay is 1/J of one clock period;

each clock signal is provided with one high-level pulse voltage during the one clock period.

11. The GOA circuit of claim 7, wherein each of the J GOA units of each group comprises a first transistor having a gate and a first terminal commonly coupled to the input terminal and a second terminal coupled to a pull-up node;

a second transistor having a gate coupled to the reset terminal, a first terminal coupled to the pull-up node, and a second terminal coupled to a third external voltage line;

a third transistor having a gate coupled to the pull-up node, a first terminal coupled to one of K clock signal lines;

a fourth transistor having a gate coupled to the reset terminal, a first terminal coupled to the first output terminal, and a second terminal coupled to the third external voltage line;

a fifth transistor having a gate coupled to a pull-down node, a first terminal coupled to the pull-up node, and a second terminal coupled to the third external voltage line;

a sixth transistor having a gate coupled to the pull-down node, a first terminal coupled to the first output terminal, and a second terminal coupled to the third external voltage line;

a seventh transistor having a gate and a first terminal commonly connected to a second external voltage line, and a second terminal coupled to a pull-down control node;

an eighth transistor having a gate coupled to the pull-down control node, a first terminal coupled to the second external voltage line, and a second terminal coupled to the pull-down node;

a ninth transistor having a gate coupled to the pull-up node, a first terminal coupled to the pull-down control node, and a second terminal coupled to the third external voltage line;

a tenth transistor having a gate coupled to the pull-up node, a first terminal coupled to the pull-down node, and a second terminal coupled to the third external voltage line; and a capacitor having a first terminal coupled to the pull-up node and a second terminal coupled to the first output terminal.

12. The GOA circuit of claim 11, wherein the pull-down node is coupled to the second output terminal so that the node voltage signal outputted at the second output terminal is equivalent to a voltage level at the pull-down node.

13. A pixel circuit of an AMOLED display panel driven by a first driving signal, a second driving signal, and a third driving signal from one stage of the GOA circuit of claim 1 and supplied with a current-source high-level voltage, a low-level voltage, a first external voltage, a second external voltage, and a data signal;

wherein the pixel circuit comprises:

a first transistor having a drain being supplied with the current-source high-level voltage, a gate coupled to a first node, and a source coupled to a third node;

a second transistor having a drain being supplied with the first external voltage, a gate receiving the second driving signal, a source coupled to the first node;

a third transistor having a drain being supplied with the data signal, a gate receiving the second driving signal, and a source coupled to a second node;

a fourth transistor having a drain coupled to the first node, a gate receiving the third driving signal, and a source coupled to the second node;

a fifth transistor having a drain being supplied with the second external voltage, a gate receiving the first driving signal, and a source coupled to the third node;

a first capacitor having a first terminal coupled to the second node and a second terminal coupled to the third node;

a second capacitor having a first terminal coupled to the third node and a second terminal being supplied with the low-level voltage; and a light emitting diode having an anode coupled to the third node and a cathode being supplied with the low-level voltage.

14. The pixel circuit of claim 13, wherein, in a first time period of a driving cycle, the first driving signal is provided as a high-level pulse voltage starting from a first time point, the second driving signal is provided as a low-level signal first and as a high-level pulse voltage from a second time point in the first time period being later in time relative to the first time point, the third driving signal is provided as a low-level signal; in a second time period subsequent to the first time period, the first driving signal becomes a low-level signal, the second driving signal remains to be the high-level pulse voltage, and the third driving signal remains the low-level signal; in a third time period subsequent to the second time period, the first driving signal remains to be the low-level signal, the second driving signal becomes a low-level signal, and the third driving signal becomes a high-level signal.

15. The pixel circuit of claim 13, wherein the light emitting diode is an organic light emitting diode.

16. An AMOLED display panel comprising the GOA circuit of claim 1 coupled to a matrix of pixels arranged in N rows, each row of pixels comprising a plurality of pixel circuits, each pixel circuit in one of the N rows being driven by one set of driving signals of the N sets of driving signals generated internally by the GOA circuit of claim 1 combined with two common external voltages and a data voltage.

17. A method of driving a pixel circuit of an AMOLED display panel, comprising:

providing a current-source high-level voltage, a low-level voltage, a first external voltage, a second external voltage, and a data signal to the pixel circuit; and providing a first driving signal, a second driving signal, and a third driving signal from one stage of a gate driver on array (GOA) circuit to the pixel circuit, thereby driving the pixel circuit;

wherein the GOA circuit comprises a plurality of GOA units cascaded in a multi-stage series of one GOA unit per stage and configured to generate at least two driving signals per stage with a timing arrangement for driving one row of pixel circuits of an AMOLED display panel, wherein driving signals for driving any one row of pixel circuits include at least one output signals from a GOA unit of a present stage and at least one output signal from a GOA unit of a previous stage;

wherein the plurality of GOA units comprise:

N GOA units from a 1st GOA unit to a N-th GOA unit, each n-th stage GOA unit selected from the N GOA units, where N is integer greater than 2 and n varies from 1 to N, including a first power-supply terminal configured to receive a high-level power-supply voltage, a second power-supply terminal configured to receive a low-level power-supply voltage, and a clock signal terminal configured to receive a clock signal, an input terminal configured to receive an output signal from a GOA unit in one of previous stages as an input signal for the input terminal, a reset terminal configured to receive an output signal from a GOA unit in one of next stages as a reset signal for the reset terminal, a first output terminal configured to output a gate-driving signal, and a second output terminal configured to output a node voltage signal;

wherein the input terminal of the n-th stage GOA unit is configured to receive an output signal from a (n−2)-th stage GOA unit as the input signal; and the reset terminal of the n-th stage GOA unit is configured to receive an output signal from a (n+2)-th stage GOA unit as the reset signal.

* * * * *